United States Patent [19]

Yoshikawa et al.

[11] Patent Number: 4,774,543

[45] Date of Patent: Sep. 27, 1988

[54] IMAGE FORMING APPARATUS WITH PLURAL DEVELOPING DEVICES

[75] Inventors: Masao Yoshikawa, Tokyo; Tatuya Kobayashi, Yokohama, both of Japan

[73] Assignee: Canon Kabushiki Kaisha, Tokyo, Japan

[21] Appl. No.: 90,020

[22] Filed: Aug. 27, 1987

[30] Foreign Application Priority Data

Aug. 30, 1986 [JP] Japan ..... 61-204626

[51] Int. Cl.[4] ..... G03G 15/01; G03G 15/08

[52] U.S. Cl. ..... 355/4; 355/3 DD; 355/14 D; 118/645; 118/657

[58] Field of Search ..... 355/4, 3 DD, 14 D, 3 R, 355/14 R; 118/645, 658, 656, 661, 653; 430/122

[56] References Cited

U.S. PATENT DOCUMENTS

| | | | |
|---|---|---|---|
| 4,308,821 | 1/1982 | Matsumoto et al. | 355/4 X |
| 4,351,604 | 9/1982 | Karasawa et al. | 355/4 |
| 4,591,261 | 5/1986 | Saruwatari et al. | 355/4 |
| 4,619,518 | 10/1986 | Kameyama et al. | 355/4 |
| 4,660,961 | 4/1987 | Kuramoto et al. | 355/4 |
| 4,682,880 | 7/1987 | Fujii et al. | 355/4 |

FOREIGN PATENT DOCUMENTS 56-12650 2/1981 Japan .

*Primary Examiner*—A. C. Prescott

*Attorney, Agent, or Firm*—Fitzpatrick, Cella, Harper & Scinto

[57] ABSTRACT

An image forming apparatus includes a movable image bearing member; a device for forming a first latent image and a second latent image; a first developing device for developing the first latent image using a first developer containing magnetic particles and toner particles to form a first developed image; a second developing device, disposed downstream of the first developing means with respect to movement direction of the image bearing member, for developing the second latent image on the image bearing member bearing the first developed image and the second latent image, using a second developer which is different from the first developer, the second developing device including a developer containing portion and developer carrying sleeve for carrying from the developer containing portion the second developer to a developing zone where the developer carrying sleeve is opposed to the image bearing member; and a magnetic field generating pole, in the second developing device, for providing an attracting surface for attracting magnetic particles of the first developer carried on the developer carrying member of the second developing device, the magnetic field generating pole being opposed to a developer carrying surface of the developer carrying sleeve and being disposed downstream of the developing zone and upstream of the developer containing portion of the second developing device with respect to movement of the second developer carried on the developer carrying sleeve.

16 Claims, 6 Drawing Sheets

IMAGE FORMING APPARATUS WITH PLURAL DEVELOPING DEVICES

FIELD OF THE INVENTION AND RELATED ART

The present invention relates to an image forming apparatus such as an electrophotographic copying machine, printer and displaying device, with a plurality of developing devices. The present invention is particularly suitable for a multi-color printer capable of forming a multi-color image.

Such a multi-color printer is known which comprises two sets of a latent image forming means for forming a latent image by imagewise exposure and a developing means for developing the latent image formed by the latent image forming means, which are disposed around a photosensitive drum in the order named, by which a two-color image can be produced. Japanese Laid-Open Patent Application Publication No. 12650/1981 discloses one of such apparatuses, wherein the first developing means disposed upstream with respect to a direction of peripheral movement of the photosensitive drum is of a contact magnetic brush type using a developer comprising magnetic carrier particles and non-magnetic chromatic color toner, and wherein the second developing means disposed downstream is of a non-contact jumping development type using black one component magnetic toner wherein the toner particles are transferred to the photosensitive member by an electric field (U.S. Pat. No. 4,356,745, for example).

This apparatus uses in the second developing means one component magnetic toner without magnetic carrier particles, and the toner particles are not contacted to the photosensitive drum, so that it is advantageous in that it can avoid the problem, arising when the second developing means of the contact magnetic brush type using magnetic carrier particles is used, that the first chromatic toner image produced by the first developing means is disturbed in the second development, and the problem that the first chromatic toner particles are mixed into the second developing means.

The jumping development wherein the one component magnetic toner particles are transferred onto the latent image by a vibrational electric field (alternating electric field) formed by a voltage applied to a developing sleeve carrying the toner particles is disclosed in U.S. Pat. Nos. 4,292,387 and 4,395,476, for example.

The development wherein the developer containing the magnetic carrier particles and toner particles are used is disclosed, for example, in U.S. Pat. Nos. 4,548,489 and 4,579,082, wherein the mixture is contained in a developer container, but toner particles only are supplied to a developing zone. However, in this type of development, the magnetic carrier particles can be supplied to the developing zone if a significant impact is applied to the developing device. To obviate this problem, U.S. Pat. No. 4,660,958 proposes that the magnetic particles which are going to reach the developing zone are collected. As an alternative, U.S. Pat. No. 4,638,760 discloses that the magnetic particles having been supplied to the developing zone are collected into the container in a single developing device.

SUMMARY OF THE INVENTION

A problem in the conventional devices is that in the developing operation by the first developing means the magnetic particles can be deposited onto the surface of the photosensitive drum although the amount thereof is small, and such magnetic particles are collected by the magnetic force provided by a magnet contained in the sleeve of the second developing means. The amount of the magnetic particles collected in one copying cycle is small. However, they are accumulated through a number of copying cycles even to such an extent that the leaked magnetic particles are formed into a magnetic brush on the sleeve of the second developing means. The magnetic brush brushes the first chromatic toner image having been formed on the photosensitive drum and disturbs it or causes the first toner particles to mix into the second developing device. In addition, the magnetic particles of the first developer can be mixed into the developer of the second developing means which is different from the developer of the first developing means for one reason or another. If this continues, the initial desirable developing conditions of the second developing means cannot be maintained since the conditions gradually change, so that various problems occur irrespective of the type of the second developing means.

Accordingly, it is a general object of the present invention to provide a solution to a problem arising from the usage of plural developing devices.

It is a principal object of the present invention to provide an image forming apparatus with plural developing devices wherein magnetic particles of the first developing device are prevented from mixing into the second developing means by way of a second developer carrying means of the second developing device with certainty, whereby the operation of the second developing means is stabilized.

It is another object of the present invention to provide an image forming apparatus with plural developing devices wherein the effective collection of the magnetic particles is provided on the basis of the particle size of the magnetic particles.

It is a further object of the present invention to provide an image forming apparatus with plural developing devices wherein the condition of effective magnetic particle collection is provided by particular magnetic force relationship for attracting the magnetic particles.

According to a first embodiment of the present invention there is provided an image forming apparatus, comprising: a movable image bearing member; means for forming a first latent image and a second latent image; first developing means for developing the first latent image using a first developer containing magnetic particles and toner particles to form a first developed image; second developing means, disposed downstream of said first developing means with respect to a movement direction of said image bearing member, for developing the second latent image on said image bearing member bearing the first developed image and the second latent image, using a second developer which is different from the first developer, said second developing means including a developer containing portion and developer carrying means for carrying from the developer containing portion the second developer to a developing zone where the developer carrying means is opposed to said image bearing member; and magnetic field generating means, in said second developing means, for providing an attracting surface for attracting magnetic particles of the first developer carried on the developer carrying member of said second developing means, said magnetic field generating means being opposed to a developer carrying surface of said developer carrying member and being disposed downstream of the developing zone and upstream of the developer containing portion of said second developing means with respect to movement of the second developer carried on said developer carrying member. The magnetic particles of the first developing means an unintentionally deposited onto the developer carrying member of the second developing device are collected by the magnetic field generating means. Therefore, it can be avoided that the magnetic particles are formed into a magnetic brush on the developer carrying member, which can disturb the developed image or causes the first toner to be mixed into the second developer.

According to a second embodiment, there is provided an apparatus having the structure of the first embodiment and wherein the second developer is a one component developer mainly containing magnetic toner particles, and wherein said second developing means includes magnetic field shielding means disposed between said magnetic field generating means and said developer containing portion to prevent magnetic force by the magnetic field generating means substantially extending into the developer containing portion. It can be avoided that the magnetic field generating means attracts the magnetic toner particles in the developer containing portion of the second developer. Therefore, occurrences of white stripe or reduction of the image density in the developed image can be avoided which may otherwise be caused when the magnetic field generating means attracts the magnetic toner particles with the result that the amount of the usable toner particles decreases. The developer carrying member may include a rotatable sleeve enclosing a stationary magnet, a rotatable magnet or a stationary sleeve enclosing a rotatable magnet.

According to a third embodiment of the present invention, there is provided an image forming apparatus, comprising: a movable image bearing member; means for forming a first latent image and a second latent image; first developing means for developing the first latent image using a first developer containing magnetic particles and toner particles to form a first developed image; second developing means, disposed downstream of said first developing means with respect to movement direction of said image bearing member, for developing the second latent image on said image bearing member bearing the first developed image and the second latent image, using a second developer which is different from the first developer, said second developing means including a deve1oper containing portion and developer carrying means for carrying from the developer containing portion the second developer to a developing zone where the developer carrying means is opposed to said image bearing member; and magnetic field generating means, in said second developing means, for providing an attracting surface for attracting magnetic particles of the first developer carried on the developer carrying member of said second developing means, said magnetic field generating means being opposed to a developer carrying surface of said developer carrying member and being disposed downstream of the developing zone and upstream of the developer containing portion of said second developing means with respect to movement of the second developer carried on said developer carrying member; wherein said second developing means further comprises a magnet in said developer carrying means, said magnet having a magnetic pole adjacent said magnetic field generating means, said magnetic pole having a magnetic polarity opposite to a magnetic polarity adjacent the attracting surface of said magnetic field generating means, wherein a maximum surface magnetic flux density G1 (Gauss) on a developer carrying surface of said developer carrying member in a direction perpendicular to the developer carrying surface provided by the magnetic pole in said developer carrying member, a maximum surface magnetic flux density G2 (Gauss) on the attracting surface in a direction perpendicular to the attracting surface provided by said magnetic field generating means, and a distance g (cm) between positions where said maximum surface magnetic flux densities occur, satisfy:

$$5\times10^5 \leqq (G1\times G2)/g \leqq 100\times10^5.$$

This defines the existence of the magnetic force between the magnet and the magnetic field generating means. This is based on a finding that the magnetic particles are positively attracted to the magnetic field generating means so that the movement of the magnetic particles into the second developing device can be prevented even if there is some impact thereto, if $5\times10^5 \leqq (G1\times G2)/g$, and that if $(G1\times G2)/g > 100\times10^5$, the attracted magnetic particles undesirably form a strong magnetic brush to disturb smooth movement of the second developer into the second developer containing portion of the second developing device with the result that the second developer scatters around. This becomes more remarkable with the increase of the amount of the magnetic particles in the clearance between the attracting surface and the developer carrying surface.

By satisfying the above conditions, the attracted magnet particles can be retained even if there is some impact to the second developing device which may be caused by movement of the developing device or demounting or mounting operation thereof with respect to the image forming apparatus. Even if the amount of the attracted toner increases, the magnetic brush formed thereby is relatively soft so as to ensure the returning of the second developer into the containing portion.

According to a fourth embodiment of the present invention, there is provided an image forming apparatus, comprising: a movable image bearing member; means for forming a first latent image and a second latent image; first developing means for developing the first latent image using a first developer containing magnetic particles and toner particles to form a first developed image; second developing means, disposed downstream of said first developing means with respect to movement direction of said image bearing member, for developing the second latent image on said image bearing member bearing the first developed image and the second latent image, using a second developer which is different from the first developer, said second developing means including a developer containing portion and developer carrying means for carrying from the developer containing portion the second developer to a developing zone where the developer carrying means is opposed to said image bearing member; and magnetic field generating means, in said second developing means, for providing an attracting surface for attracting magnetic particles of the first developer carried on the developer carrying member of said second developing means, said magnetic field generating means being opposed to a developer carrying surface of said developer carrying member and being disposed downstream of the developing zone and upstream of the developer containing portion of said second developing means with respect to movement of the second developer carried on said developer carrying member; wherein said second developing means comprises a magnet in said developer carrying member, said magnet having a magnetic pole of a polarity opposite to that of the attracting surface of said magnetic field generating means and opposed to said magnetic field generating means, and wherein a half peak width within which the surface magnetic flux density on the attracting surface in a direction perpendicular to the attracting surface is not less than one half a maximum surface magnetic flux density is within a range in which a magnetic field in a direction perpendicular to the developer carrying surface of said developer carrying member provided by the magnetic pole by the magnet exists. This is based on a finding that the half peak width on the attracting surface mainly controls the attraction and retaining of the magnetic particles. By placing the half peak width range as defined above, the directions of the magnetic lines of force are generally perpendicular to the developer carrying surface of the developer carrying member, by which the retaining of the magnetic particles is assured.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 7:
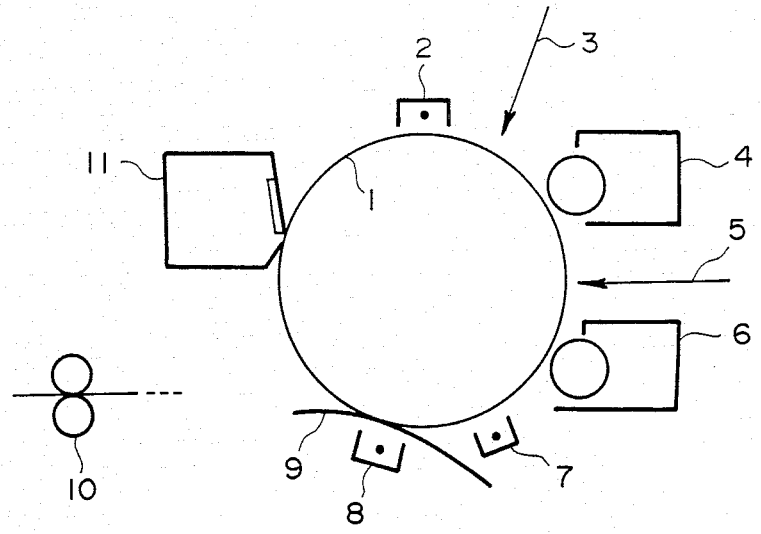
FIG. 7 is a sectional view of an image forming apparatus according to an embodiment of the present invention.

Referring first to FIG. 7, there is shown an electrophotographic copying machine according to a first embodiment of the present invention, which comprises a photosensitive drum 1, a charger 2, a first developing device 4, a second developing device 6, a post charger 7, a transfer charger 8, a cleaning means 11 and a fixing means 10. The photosensitive drum 1 is uniformly charged by a charger 2 and is exposed to first image light 3 by an unshown exposure means with a laser beam or the like. The first image exposure light 3 provides on the photosensitive drum 1 a negative electrostatic latent image wherein the image portion is exposed to the light. The thus formed electrostatic latent image is developed through a reversal development by the first developing device 4 with chromatic toner, for example, red toner, which is charged to a negative polarity. By the development, the first developed image is produced. In the development by the first developing device 4, two component developer is used which contains magnetic particles having an average particle size of 30–70 microns and chromatic non-magnetic toner particles, and a known magnetic brush development is performed in this embodiment.

Then, the photosensitive drum 1 is exposed to the second image light 5 by an unshown second exposure means with a laser beam or the like. The second image exposure by the light 5 is a background exposure or a positive exposure wherein the non-image-area is exposed to the light, whereby a positive electrostatic latent image is formed on the photosensitive drum 1. The second electrostatic latent image is developed through a regular development by the second developing device 6 with positively charged black toner, so that a second developed image is produced. In the second development, a one component developer is used which contains as a major component magnetic black toner particles having an average particle size of 5–15 microns without carrier particles, and the above described jumping development method is used.

Subsequently, the first and second developed images formed on the photosensitive drum 1 are charged to the same polarity by the post charger 7, and then are transferred onto a transfer sheet 7 by the transfer charger 8. The transferred images are fixed by the image fixing device 10. The toner particles remaining on the photosensitive drum 1 is removed by the cleaning device 11, so that the photosensitive drum 1 is prepared for the next image forming operations.

In this embodiment, the second developing device 6 is provided with magnetic field generating means for attracting magnetic particles from a developer carrying member of the second developing device 6, the magnetic field generating means being disposed adjacent the developer carrying member.

Figure 1:
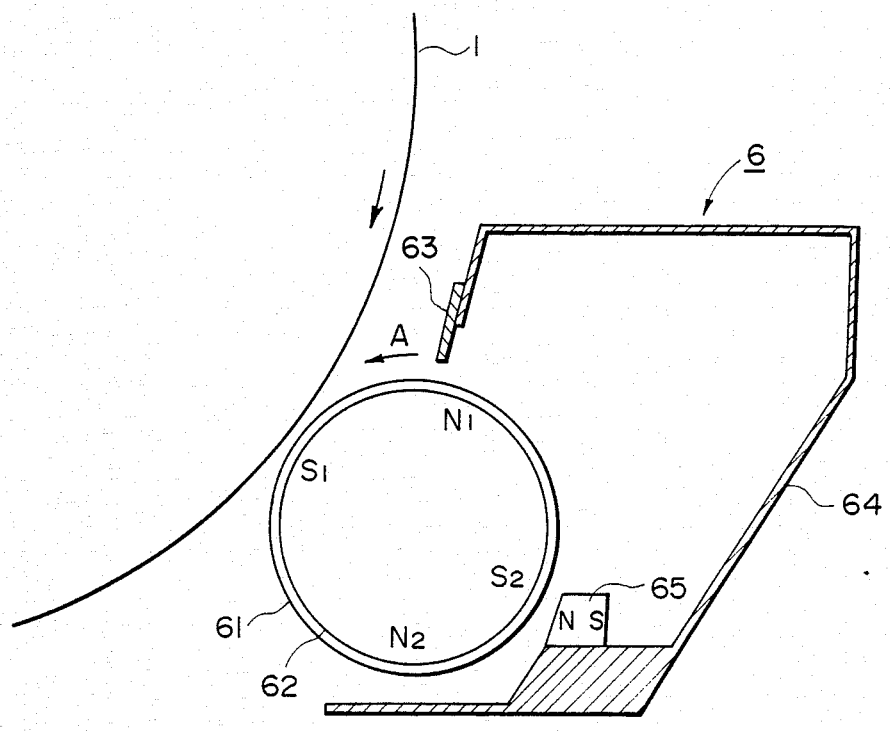
FIG. 1 is a sectional view of a developing apparatus usable with an image forming apparatus according to an embodiment of the present invention.

Referring to FIG. 1, this will be explained in detail. The second developing device 6 includes a developer container 64 functioning as a developer containing portion, which is provided with an opening, in which a developing sleeve 61 functioning as the developer carrying member is disposed. The developing sleeve 61 rotates in a direction indicated by an arrow A. The developer is carried on the sleeve to the developing zone and then back to the container 64. A bar magnet 64 having a square cross section and functioning as the magnetic field generating means, is disposed adjacent to the developing sleeve 61 adjacent an upstream side in the container 64 with respect to the rotational direction A of the developing sleeve 61. The bar magnet 61 has a magnetic pole of N polarity faces through the developing sleeve 61 to a stationary magnetic pole S2, having the opposite polarity of a stationary magnet roll 62 enclosed by the developing sleeve 61. The bar magnet 65 is effective to attract the magnetic particles from the developing sleeve 61 to remove them from the sleeve 61 by the magnetic field produced by the bar magnet 65 alone or provided by the magnetic field toward the bar magnet 65 by the cooperation between the stationary magnetic pole S2 of the magnet roll 62 and the bar magnet 65. The second developing device 6 further comprises a blade for applying the black toner (one component developer) on the rotating developing sleeve 61 as a toner layer having a uniform thickness.

The clearance between the surface of the developing sleeve 61 and the bar magnet 65 is 1.0–5.0 mm, preferably 3.0–4.0 mm, since if it is too small, the toner is not satisfactorily conveyed and since if it is too large, the magnetic field becomes weak. The magnetic flux density provided by the bar magnet 64 is preferably not less than 300 Gausses on the surface thereof.

Figure 2:
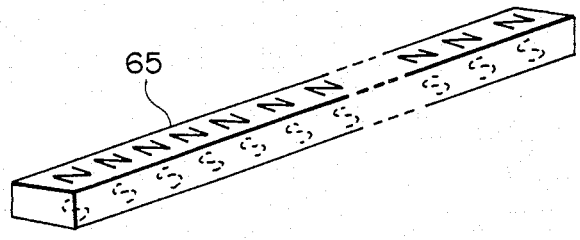
FIG. 2 is a perspective view of a bar magnet usable with the developing device of the image forming apparatus according to this invention.

Referring to FIG. 2, the pattern of the magnetization in the bar magnet 65 is preferably as shown in this Figure, wherein it is magnetized to the same magnetic polarity adjacent the entire magnetic particle attracting surface.

According to this embodiment, the bar magnet 65 for attracting the magnetic particles away from the developing sleeve 61 is disposed adjacent the developing sleeve in the second developing device 6, even if the magnetic particles in the first developing device 4 performing the two component magnetic brush development are deposited onto the photosensitive drum 1 and are collected on the developing sleeve 61 of the second developing device 6, the magnetic particles are removed from the sleeve 61 by the bar magnet 65. Therefore, it can be avoided that the magnetic particles from the first developing device are formed into a magnetic brush on the developing sleeve 61 of the second developing device 6 and that the magnetic brush disturbs the first developed image or that the red toner is brought into and mixed into the second developing device 6.

Figure 4:
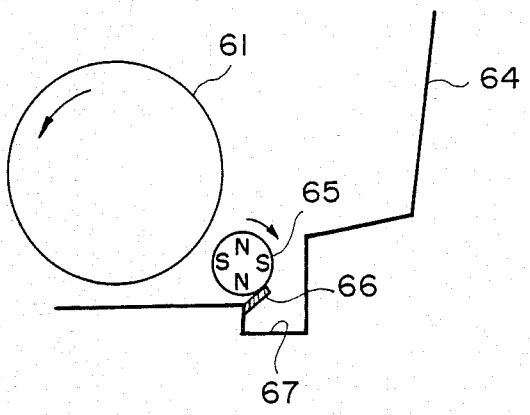
FIGS. 4–6 are sectional views of major parts of the developing apparatus usable with the image forming apparatus according to this invention.

Referring to FIG. 4, a modification of the first embodiment will be described. In this figure, same reference numerals are assigned to the elements having the corresponding functions, in place of detailed explanation, for the sake of simplicity. In this modified arrangement, the bar magnet 65 has a circular cross section and is rotatable. The bar magnet 65 is normally not rotated with its N-pole being faced to a stationary S-pole (S2) of the magnet roll 62 in the developing sleeve 61. After the developing operation is completed, it is rotated, by which a scraper 66 of magnetic material such a rubber and phosphor bronze scrapes the magnetic particles collected thereby off the bar magnet 65. The scraped magnetic particles are accumulated in a sump 67.

According to this modified arrangement, the bar magnet 65 can be maintained under magnetic particle-free condition so that the magnetic particles are collected more efficiently. The magnetization pattern of the bar magnet 65 is as shown in FIG. 2.

Figure 5:
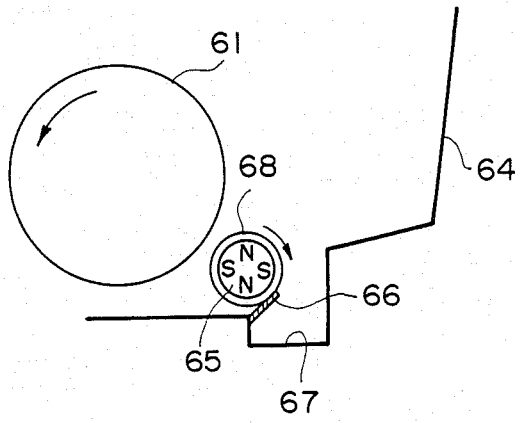

Referring to FIG. 5, a further modification of the first embodiment will be described. In this figure, the same reference numerals are assigned to the elements having the corresponding functions, in place of detailed explanation thereof, for the sake of simplicity. In this modified arrangement, the bar magnet 65 is of a circular cross section and is stationary. The bar magnet 65 is enclosed by a sleeve 68 of non-magnetic material which is rotatable in a direction of an arrow. The other structure and function are the same as explained in conjunction with FIG. 4, and therefore, detailed explanation is omitted.

Figure 6:
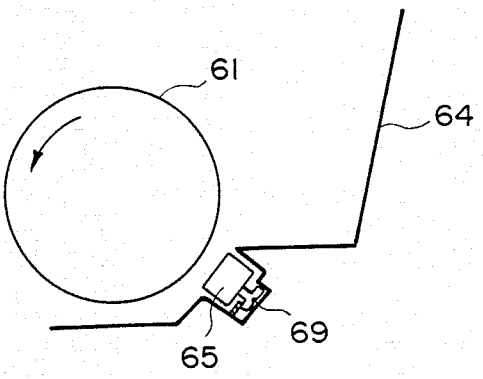

Referring to FIG. 6, a yet further modification of the first embodiment will be described. In this figure, the same reference numerals are assigned to the elements having the corresponding functions, in place of detailed explanation thereof, for the sake of simplicity. In this modified arrangement, the bar magnet 64 is of a square cross section and is provided with a rail 69. The bar magnet 65 is detachably mountable into the developing device 6 by a sliding movement using the rail 69. According to this modified arrangement, the bar magnet 65 is easily cleaned or replaced. The other structure and function are the same as described in conjunction with FIG. 7.

Figure 8:
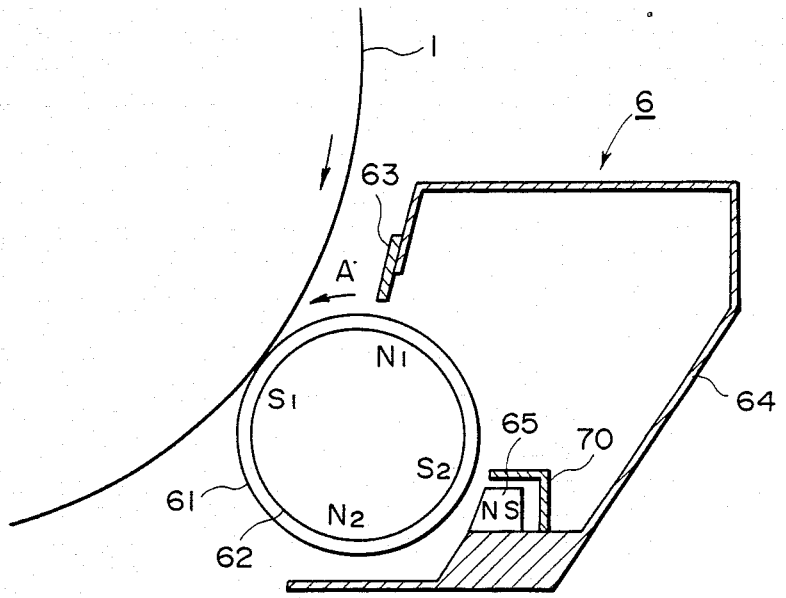
FIG. 8 is a sectional view of a developing apparatus of an image forming apparatus according to a second embodiment of the present invention.
Figure 9:
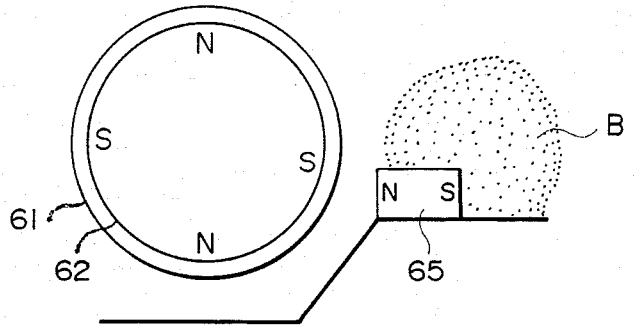
FIG. 9 is a sectional view of a part of the developing apparatus show in FIG. 1.

Referring to FIG. 8 a second embodiment will be described. In this figure, the same reference numerals are assigned to the elements having the corresponding functions, in place of detailed explanation thereof, for the sake of simplicity. In the second embodiment, there is additionally provided a magnetic field shielding means outside the magnetic field generating means toward the inside of the developer container. Since in the first embodiment, the bar magnet 65 is exposed toward the inside of the toner container 64, the toner particles which are magnetic can be attracted to the bar magnet 65 to accumulate the toner particles as indicated by a reference B in FIG. 9. As a result, the toner circulation in the toner container 64 can be obstructed so that the developing performance may be influenced.

In this second embodiment, there is provided a magnetic shield 70 having an "L" shape to cover the face of the bar magnet 65 which is faced to the inside of the toner container 64, whereby the magnetic lines of force by the bar magnet 65 is prevented or reduced from leaking into the toner container 64. The magnetic shield 70 is of a material having high permeability, such as iron which may be plated with proper material to prevent rusting.

Figure 11:
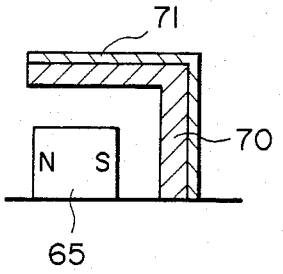
FIG. 11 is a sectional view of a magnetic shield.

As shown in FIG. 11, that face of the magnetic shield 70 which is opposed to the inside of the toner container 64 may be coated with non-magnetic material layer, for example, of synthetic resin material.

Figure 10:
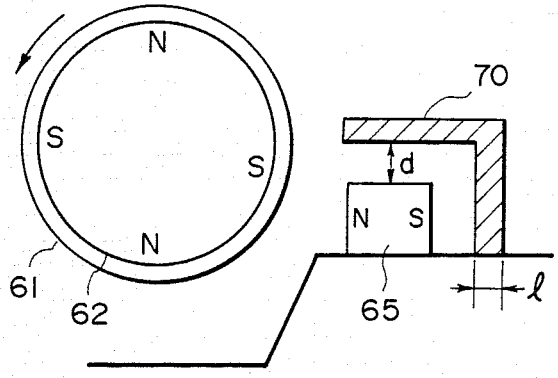
FIG. 10 is an enlarged sectional view of the developing apparatus of FIG. 8.

If the clearance d (FIG. 10) between the magnetic shield 70 and the bar magnet 65 is too small, the function of the magnetic shield is weakened. Therefore, it is preferable that the clearance d is so determined in consideration of the surface magnetic flux density of the bar magnet 65, the permeability of the magnetic shield material and the shape thereof that the magnetic lines of force by the bar magnet 65 are closed within the magnetic shield 70. As an example, when the surface magnetic flux density of the bar magnet 65 is 400–1000 Gauss, and the magnetic shield 70 of iron has a thickness l is not less than 1.0 mm and not more than 2.0 mm, the preferable clearance d is not less than 0.5 mm, since then the accumulated toner decreases or disappears. If, however the clearance d is too large, the volume of the toner container 64 becomes smaller, it is preferable that the clearance d satisfies $0.5\ \text{mm} \leqq d \leqq 5.0\ \text{mm}$.

As described, since the provision of the magnetic shield 70 is effective to eliminate or reduce to such an extent that the developing performance is not influenced, the accumulated toner B which is otherwise formed at that side of the bar magnet 65 which faces the inside of the toner container 64 is decreased or disappeared, and therefore, the toner circulation in the container 64 is maintained under good conditions, thus eliminating white stripes or low density portion in the developed images.

Figure 12:
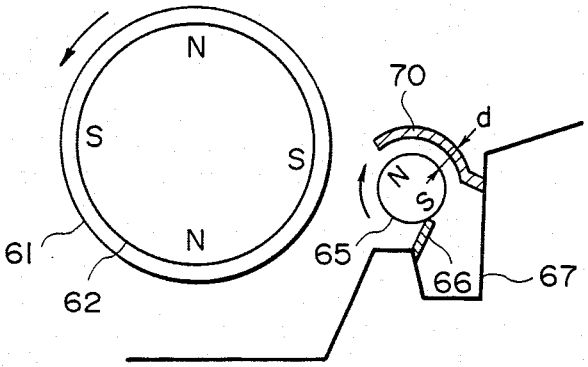
FIG. 12 is a sectional view of a developing apparatus of an image forming apparatus according to another embodiment of the present invention.

Referring to FIG. 12, a modification of the second embodiment will be described. In this figure, the same reference numerals are assigned to the elements having the corresponding functions, in place of detailed explanation thereof, for the sake of simplicity. In this modified arrangement, the bar magnet 65 is of a circular cross section and is rotatable. Correspondingly, the magnetic shield 70 is of semi-cylindrical cross section. Similarly to the original form of the second embodiment, the magnetic shield 70 is effective to prevent the formation of the accumulated toner. In addition, the bar magnet 65 is normally not rotating with its N-pole maintained opposed to the stationary S-pole S2 of the magnet roll 62 in the developing sleeve 61, and it rotates after completion of the developing operation, so that the magnetic particles collected on the bar magnet 65 are scraped thereoff by a scraper 66 made of elastic material such as rubber and phosphor bronze. The scraped magnetic particles are accumulated in the toner sump. In this modified arrangement, the bar magnet 65 is maintained under magnetic-particles-free condition, so that the magnetic particle collecting efficiency can be increased. As an example, when the surface magnetic flux density by the bar magnet 65 is approximately 600 Gausses, and the magnetic shield has a thickness l of 1.5 mm and is made of iron, the similar effects are provided when the clearance d is $\leqq 0.5$ mm.

In the foregoing embodiment, the bar magnet 65 is disposed faced to the stationary magnetic pole S2 of the magnet roller 62 in the developing sleeve 61.

Figure 13:
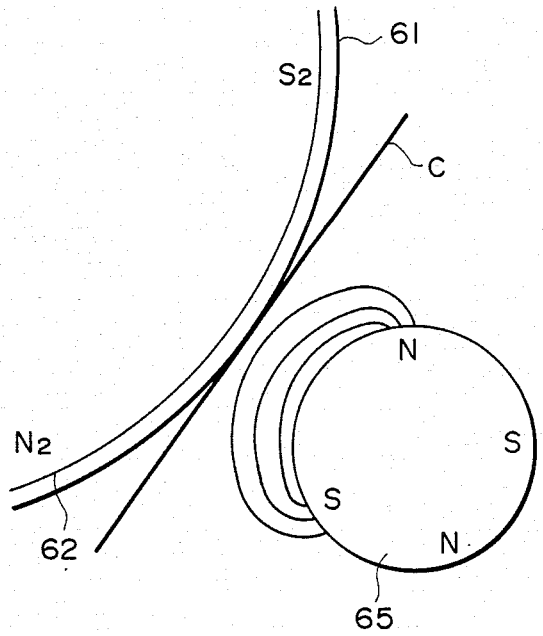
FIG. 13 is a sectional view illustrating the magnetic field of a developing device in an image forming apparatus according to an embodiment of the present invention.

Referring to FIG. 13, however, the bar magnet 65 may be disposed not faced to the fixed magnetic pole of the magnet roller 62 with the magnetic poles of the bar magnet 65 being on a line substantially parallel to a tangential line c of the developing sleeve 61. In this arrangement, the position where the magnetic particles are removed is away from a position where the magnetic force by the magnet roller 62 is strongest, so that the removing attraction is performed with less difficulty. In addition, since the magnetic lines of force by the bar magnet 65 extend substantially parallel to the tangential line c of the developing sleeve 61, the magnetic flux density provided by the magnetic lines of force by the bar magnet 65 may be changed by adjusting the distance between the bar magnet 65 and the developing sleeve 61 so as to collect of the magnet particles only with certainty. Such a setting is easier in this modified arrangement.

In the foregoing embodiments and modifications thereto, the second developing device 6 is of a jumping development type wherein the toner is not directly contacted to the photosensitive drum 1. However, the present invention is applicable to the second developing device of a contact type. If this application is made, the development parameters can be maintained properly in the second developing device without disturbance thereto by the magnetic particles brought from the first developing device to the second developing device. Therefore, the image quality can be maintained.

Figure 3:
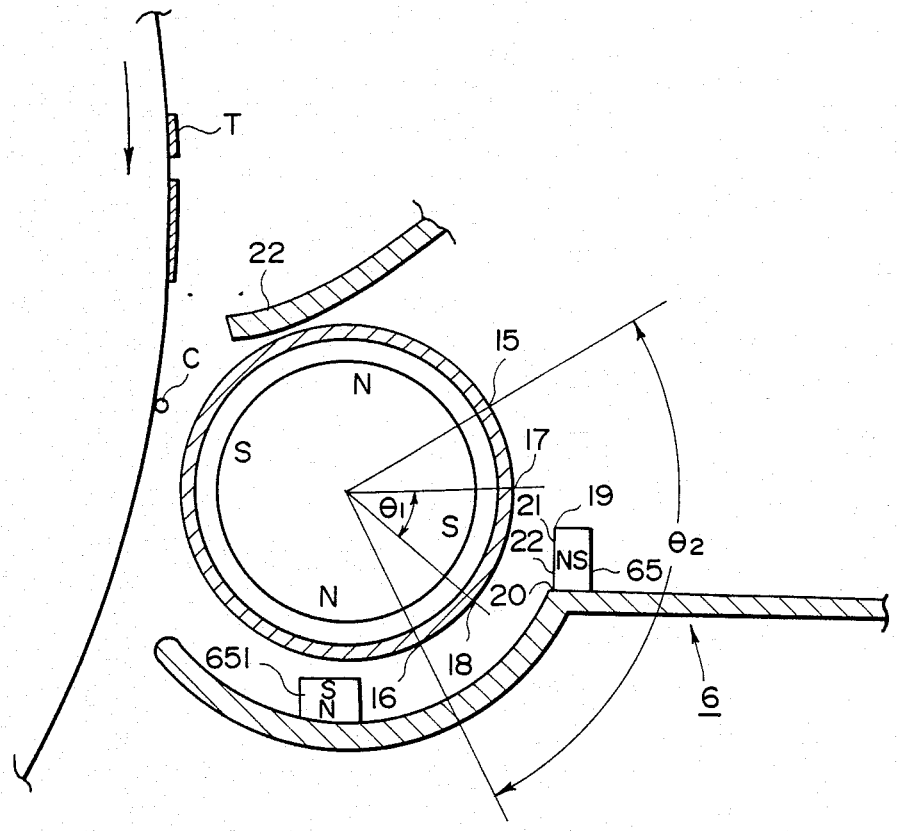
FIG. 3 is a sectional view of a preferred embodiment of the present invention.

Referring to FIG. 3, the third and fourth embodiments will be described.

FIG. 3 is a sectional view of a major part of a second developing device 6 which is disposed downstream of the first developing device 4 with respect to movement direction of the image bearing member, more particularly, below the first developing device 4 in an image forming apparatus shown in FIG. 7. The developing sleeve rotates in the counterclockwise direction in FIG. 3 to carry the magnetic developer thereon in the counterclockwise direction by cooperation with magnetic force provided by the magnet roller in the sleeve, the magnet roller having four poles (N, S, N, S polarities). The magnet roller is stationary so that it does not rotate when the sleeve rotates. The photosensitive drum is shown as carrying a toner image T provided by the first developing device 4 and also carrying magnetic particles C which are unintentionally deposited onto the photosensitive drum by the first developing device. The photosensitive drum is grounded, while a combination of an alternating voltage and a DC voltage is applied to the developing sleeve to form an alternating (vibrational) electric field across the clearance between the developing sleeve and the photosensitive drum surfaces, as shown in U.S. Pat. Nos. 4,292,387 and 4,395,476.

The second developing device 6 includes an elastic blade 22 as shown in U.S. Pat. No. 4,458,627, for example, having an antinode side press-contacted to the surface of the developing sleeve and a stationary magnet 65 for attracting the magnetic particles C from the first developing device 4. The magnetic pole S of the magnet roller which is substantially opposed to the photosensitive member, more particularly the magnetic pole S shown as being opposed to the magnetic particle C in FIG. 3, is a magnetic field generating portion for providing a magnetic field in the developing zone of the second developing device 6, and is different from the magnetic pole S substantially opposed to the stationary magnet 65. The area between the magnetic pole N substantially opposed to the elastic blade 22 and the magnetic pole S substantially opposed to the stationary magnet 65 is opposed to the developer containing portion of the second developing device 6.

The magnetic pole S of the magnet roller substantially opposed to the stationary magnet 65 provides magnetic force within an angular range $\theta 2$ formed between positions 15 and 16 at which the surface magnetic flux densities on the developing sleeve in a direction perpendicular to the surface of the developing sleeve become 0 Gauss. Also, it provides a half peak width $\theta 1$ between the positions 17 and 18 at which the surface magnetic flux density is one half the maximum surface magnetic flux density.

The magnet 65 has a magnetic pole N, which is opposite to the polarity of the magnetic pole S of the magnet roller. The N-pole of the magnet 65 provides by itself 0 Gauss positions 19 and 20 on its magnetic particle attracting surface and provides a half peak width thereon between the positions 21 and 22 at which the magnetic flux density is one half the maximum surface magnetic flux density by the magnetic pole N.

In this embodiment, the entire magnetic force range between the positions 19 and 20 are included in the half peak width $\theta 1$ between the positions 17 and 18 of the magnetic pole S of the magnet roll. In this embodiment, the maximum surface flux density G2 of the magnet 65 is 700 Gauss, and the maximum surface magnetic flux density G1 of the magnetic pole S of the magnet roller is 600 Gauss. Also, a distance g between the maximum surface flux density positions is 0.1 cm or 0.2 cm. With those settings, the magnetic carrier particles C were sufficiently attracted and retained in a stabilized manner and for a long period of time.

Even when the first developing device was such that a relatively large amount of magnetic particles was deposited onto the surface of the photosensitive drum surface, no toner scattering and no reduction of developing performance in the second developing device by the magnetic particles C brought thereinto were observed even after 3000–4000 multicolor copies were produced. Therefore, the volumic capacity of the magnetic particle attracting by the magnet 65 can be set to be larger than the durability of the second developing device, and then, the second developing device 6 may be of a disposable type. The average particle size of the magnetic particles C was 50–70 microns.

An investigation of the magnetic particle attracting power by the magnet 60 and have found the following.

First, when the magnetic particle collecting region is formed by two magnetic poles having opposite polarities wherein a line connecting the magnetic poles is across the second developer passage, as described above, the collecting region can be clogged with magnetic particles. On the basis of this finding, an investigation was made of the clogging when the magnetic power of the magnets, a distance between the developing sleeve and the magnet 65 and the magnetic particles are changed. As a result, it has been found that a long term attraction can be assured if the minimum clearance between the developing sleeve and the magnetic particle attracting surface of the magnet 65 is not less than 10 times the particle size of the magnetic particles. Also, it has been found that the minimum clearance is not less than 1 mm and not more than 3 mm to provided the stabilized attracting function and the stabilized second developer conveyance even when the rotational speed of the developing sleeve and the size of the collecting region are changed.

Second, the magnetic particle attracting power increases with increase of the magnetic force in the collecting region, but the returning of the second developer into the developer containing portion is deteriorated. Additionally, the attracted magnetic particles are unintentionally brought into the second developing containing portion even by an impact thereto caused when the developing apparatus is mounted or demounted with respect to the image forming apparatus or when the developing device is carried. It has been found that the problem is obviated if a maximum surface magnetic flux density G1 (Gauss) on a developer carrying surface of the developer carrying member in a direction perpendicular to the developer carrying surface provided by the magnetic pole in the developer carrying member, a maximum surface magnetic flux density G2 (Gauss) on the attracting surface in a direction perpendicular to the attracting surface provided by the magnetic field generating means, and a distance g (cm) between positions where the maximum surface magnetic flux densities occur, satisfy:

$$5\times10^5 \leqq (G1\times G2)/g \leqq 100\times10^5.$$

Particularly when the developing sleeve is rotated at a high speed, the impact between the attracted magnetic particles and the second developer carried on the developer carrying member becomes strong. Even under this condition, the second developer is returned into the containing portion, while the magnetic particles are stably retained, if $(G1\times G2)/g$ is not less than $10^5$ and not more than $50\times10^5$. It is considered that this effect can be provided because the magnetic brush formed by the magnetic particles is sufficiently flexible to preserve the brush-state even if it is bent along the developing sleeve surface.

If the strength of the magnetic field, defined by $(G1\times G2)/g$ is larger than $100\times10^5$, it acquires significant influence to the magnetic developer in the developer containing portion with the result of deteriorating the developing performance of the second developing device. However, if the above-described conditions are satisfied, it is advantageous that there is no need of providing the magnetic shield 70 as shown in FIG. 8.

Third, when the half peak width range between positions 21 and 22 of the magnet 65 is placed within the half peak width defined by the angle $\theta 1$ by the magnetic pole S, as shown in FIG. 3, the magnetic brush extends substantially uniformly in a direction perpendicular to the surface of the developing sleeve. Therefore, the attraction of the magnetic particles is improved. In addition, the accumulation of the second developer can be prevented, so that even if the second developer is slightly accumulated upstream of the attracted magnetic particles as a result of quite strong impact, the second developer is effectively prevented from scattering. In addition, if the half peak width range between the positions 21 and 22 by the magnet 65 is within the magnetic force existing region by the magnetic pole S defined by the angle $\theta 2$, the second developer is satisfactorily returned and the magnetic particles are retained also satisfactorily under usual conditions although very slight amount of the second developer is accumulated.

Fourthly, it has been found that in order to stably collect the second developer and retain the magnetic particles for a long period of time even when the amount of the attracted magnetic particles becomes large, it is desirable that the position where the surface magnetic flux density by the magnet 65 is maximum is upstream of a position where the surface magnetic flux density by the magnetic pole S in the developing sleeve is maximum so that the magnetic brush extends downstream from the magnet 65 with respect to movement direction of the second developer. Further, the stabilized attracting effect can be provided when the difference between the magnetic flux density at the attracting surface side and that of the developer carrying surface side is not more than 350 Gausses. Furthermore, in order to enhance this advantage, it is preferable that the maximum surface magnetic flux density at the attracting surface side is larger than that of the developer carrying surface side.

In the foregoing description, the magnetic particle attracting magnet has been described with the magnet 65 as a representative. However, as shown in FIG. 3, a magnet 651 opposed to the magnetic pole N of the magnet roller immediately after the developing zone may be provided. The magnet 651 satisfies the same conditions as the magnet 65 satisfies. The magnet 651 may be provided alone or in addition to the magnet 65. If they are provided both as shown in FIG. 3, the magnetic particle collecting power is enhanced.

According to this embodiment, the image formation of the image forming apparatus having plural developing devices is improved.

The present invention is applicable to the structure wherein the second developing device uses two developer containing particles which are different from the toner particles of the first developing device.

The present invention covers the structure disclosed herein individually or in combination.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

means for forming a first latent image and a second latent image;

first developing means for developing the first latent image using a first developer containing magnetic particles and toner particles to form a first developed image;

second developing means, disposed downstream of said first developing means with respect to movement direction of said image bearing member, for developing the second latent image on said image bearing member bearing the first developed image and the second latent image, using a second developer which is different from the first developer, said second developing means including a developer containing portion and developer carrying means for carrying from the developer containing portion the second developer to a developing zone where the developer carrying means is opposed to said image bearing member; and magnetic field generating means, in said second developing means, for providing an attracting surface for attracting magnetic particles of the first developer carried on the developer carrying member of said second developing means, said magnetic field generating means being opposed to a developer carrying surface of said developer carrying member and being disposed downstream of the developing zone and upstream of the developer containing portion of said second developing means with respect to movement of the second developer carried on said developer carrying member.

2. An apparatus according to claim 1, wherein the second developer is a one component developer mainly containing toner particles, and wherein said second developing means includes means for forming on said developer carrying member a developer layer having a thickness smaller than a clearance between said image bearing member and developer carrying member surfaces and means for vibrating the second developer by forming a vibrational electric field across the clearance.

3. An apparatus according to claim 1, wherein the second developer is a one component developer mainly containing magnetic toner particles, and wherein said second developing means includes magnetic field shielding means disposed between said magnetic field generating means and said developer containing portion to prevent magnetic force by the magnetic field generating means from substantially extending into the developer containing portion.

4. An apparatus according to claim 1, wherein said second developing means is of a disposable type which is detachably mountable into said image forming apparatus.

5. An apparatus according to claim 1, wherein a clearance between the magnetic particle attracting surface of said magnetic field generating means and said developer carrying member of said second developing means is not less than 1.0 mm and not more than 5.0 mm.

6. An image forming apparatus, comprising:

a movable image bearing member;

means for forming a first latent image and a second latent image;

first developing means for developing the first latent image using a first developer containing magnetic particles and toner particles to form a first developed image;

second developing means, disposed downstream of said first developing means with respect to movement direction of said image bearing member, for developing the second latent image on said image bearing member bearing the first developed image and the second latent image, using a second developer which is different from the first developer, said second developing means including a developer containing portion and developer carrying means for carrying from the developer containing portion the second developer to a developing zone where the developer carrying means is opposed to said image bearing member; and magnetic field generating means, in said second developing means, for providing an attracting surface for attracting magnetic particles of the first developer carried on the developer carrying member of said second developing means, said magnetic field generating means being opposed to a developer carrying surface of said developer carrying member and being disposed downstream of the developing zone and upstream of the developer containing portion of said second developing means with respect to movement of the second developer carried on said developer carrying member;

wherein said magnetic particle attracting surface of said magnetic field generating means and said developer carrying member of said second developing means is spaced apart, with a minimum clearance which is not less than 10 times an average particle size of the magnetic particles and not more than 5 mm.

7. An apparatus according to claim 6, wherein the minimum clearance is not less than 1 mm and not more than 3 mm.

8. An image forming apparatus, comprising:

a movable image bearing member;

means for forming a first latent image and a second latent image;

first developing means for developing the first latent image using a first developer containing magnetic particles and toner particles to form a first developed image;

second developing means, disposed downstream of said first developing means with respect to movement direction of said image bearing member, for developing the second latent image on said image bearing member bearing the first developed image and the second latent image, using a second developer which is different from the first developer, said second developing means including a developer containing portion and developer carrying means for carrying from the developer containing portion the second developer to a developing zone where the developer carrying means is opposed to said image bearing member; and magnetic field generating means, in said second developing means, for providing an attracting surface for attracting magnetic particles of the first developer carried on the developer carrying member of said second developing means, said magnetic field generating means being opposed to a developer carrying surface of said developer carrying member and being disposed downstream of the developing zone and upstream of the developer containing portion of said second developing means with respect to movement of the second developer carried on said developer carrying member;

wherein said developer carrying member comprises a magnet, said magnet having a magnetic pole adjacent said magnetic field generating means, said magnetic pole having a magnetic polarity opposite to a magnetic polarity adjacent the attracting surface of said magnetic field generating means, wherein a maximum surface magnetic flux density G1 (Gauss) on a developer carrying surface of said developer carrying member in a direction perpendicular to the developer carrying surface provided by the magnetic pole in said developer carrying member, a maximum surface magnetic flux density G2 (Gauss) on the attracting surface in a direction perpendicular to the attracting surface provided by said magnetic field generating means, and a distance g (cm) between positions where said maximum surface magnetic flux densities occur, satisfy:

$$5\times10^5 \leqq (G1\times G2)/g \leqq 100\times10^5.$$

9. An apparatus according to claim 8, wherein the following is satisfied:

$$10\times10^5 \leqq (G1\times G2)/g \leqq 50\times10^5.$$

10. An image forming apparatus, comprising:

a movable image bearing member;

means for forming a first latent image and a second latent image;

first developing means for developing the first latent image using a first developer containing magnetic particles and toner particles to form a first developed image;

second developing means, disposed downstream of said first developing means with respect to movement direction of said image bearing member, for developing the second latent image on said image bearing member bearing the first developed image and the second latent image, using a second developer which is different from the first developer, said second developing means including a developer containing portion and developer carrying means for carrying from the developer containing portion the second developer to a developing zone where the developer carrying means is opposed to said image bearing member; and magnetic field generating means, in said second developing means, for providing an attracting surface for attracting magnetic particles of the first developer carried on the developer carrying member of said second developing means, said magnetic field generating means being opposed to a developer carrying surface of said developer carrying member and being disposed downstream of the developing zone and upstream of the developer containing portion of said second developing means with respect to movement of the second developer carried on said developer carrying member;

wherein said developer carrying member comprises a magnet, said magnet having a magnetic pole of a polarity opposite to that of the attracting surface of said magnetic field generating means and opposed to said magnetic field generating means, and wherein a half peak width within which the surface magnetic flux density on the attracting surface in a direction perpendicular to the attracting surface is not less than one half a maximum surface magnetic flux density is within a range in which a magnetic field in a direction perpendicular to the developer carrying surface of said developer carrying member provided by the magnetic pole by the magnet substantially exists.

11. An apparatus according to claim 10, wherein a range of said half peak width is contained in a half peak width range within which the surface magnetic flux density on said developer carrying surface in a direction perpendicular to the developer carrying surface by said magnet is not less than one half of a maximum surface magnetic flux density on said developer carrying surface.

12. An image forming apparatus, comprising:

a movable image bearing member;

means for forming a latent image;

first developing means for developing the latent image using a first developer containing magnetic particles and toner particles;

second developing means, disposed substantially below said first developing means, for developing the a latent image on said image bearing member using a second developer which is different from the first developer, said second developing means including a developer containing portion and developer carrying means for carrying from the developer containing portion the second developer to a developing zone where the developer carrying means is opposed to said image bearing member; and magnetic field generating means, in said second developing means, for providing an attracting surface for attracting magnetic particles of the first developer carried on the developer carrying member of said second developing means, said magnetic field generating means being opposed with a clearance to a developer carrying surface of said developer carrying member and being disposed downstream of the developing zone and upstream of the developer containing portion of said second developing means with respect to movement of the second developer carried on said developer carrying member.

13. An apparatus according to claim 12, wherein said developer carrying member comprises a magnet, said magnet having a magnetic pole of a polarity opposite to that of the attracting surface of said magnetic field generating means and opposed to said magnetic field generating means, and wherein a half peak width within which the surface magnetic flux density on the attracting surface in a direction perpendicular to the attracting surface is not less than one half a maximum surface magnetic flux density is within a range in which a magnetic field in a direction perpendicular to the developer carrying surface of said developer carrying member provided by the magnetic pole by the magnet exists.

14. An apparatus according to claim 13, wherein a range of said half peak width is contained in a half peak width range within which the surface magnetic flux density on said developer carrying surface in a direction perpendicular to the developer carrying surface by said magnet is not less than one half a maximum surface magnetic flux density on said developer carrying surface.

15. An apparatus according to claim 12, wherein said developer carrying member comprises a magnet, said magnet having a magnetic pole adjacent said magnetic field generating means, said magnetic pole having a magnetic polarity opposite to a magnetic polarity adjacent the attracting surface of said magnetic field generating means, wherein a maximum surface magnetic flux density G1 (Gauss) on a developer carrying surface of said developer carrying member in a direction perpendicular to the developer carrying surface provided by the magnetic pole in said developer carrying member, a maximum surface magnetic flux density G2 (Gauss) on the attracting surface in a direction perpendicular to the attracting surface provided by said magnetic field generating means, and a distance g (cm) between positions where said maximum surface magnetic flux densities occur, satisfy:

$$5\times10^5 \leqq (G1\times G2)/g \leqq 100\times10^5.$$

16. An apparatus according to claim 15, wherein the following is satisfied:

$$10\times10^5 \leqq (G1\times G2)/g \leqq 50\times10^5.$$

* * * * *

UNITED STATES PATENT AND TRADEMARK OFFICE

CERTIFICATE OF CORRECTION

PATENT NO. : 4,774,543

DATED : September 27, 1988

INVENTOR(S) : MASAO YOSHIKAWA, ET AL.

It is certified that error appears in the above-identified patent and that said Letters Patent is hereby corrected as shown below:

COLUMN 3

Line 6, "an" should be deleted.
Line 12, "causes" should read --cause--.

COLUMN 5

Line 20, "retaining" should read --retention--.
Line 52, "show" should read --shown--.

COLUMN 6

Line 43, "is" should read --are--.
Line 60, "bar magnet 64" should read --bar magnet 65--.
Line 65, "bar magnet 61" should read --bar magnet 65--.
Line 66, "faces" should read --facing--.

COLUMN 7

Line 17, "bar magnet 64" should read --bar magnet 65--.

COLUMN 8

Line 8, "bar magnet 64" should read --bar magnet 65--.
Line 35, "is" should read --are--.
Line 55, "l is not" should read --l not--.

UNITED STATES PATENT AND TRADEMARK OFFICE

CERTIFICATE OF CORRECTION

PATENT NO. : 4,774,543

DATED : September 27, 1988

INVENTOR(S) : MASAO YOSHIKAWA, ET AL.

It is certified that error appears in the above-identified patent and that said Letters Patent is hereby corrected as shown below:

COLUMN 11

Line 13, "magnet 60 and have" should read --magnet 65--.
Line 23, "long" should read --long- --.
Line 29, "provided" should read --provide--.

COLUMN 16

Line 25, "a" should be deleted.

Signed and Sealed this

Fifteenth Day of May, 1990

*Attest:*

HARRY F. MANBECK, JR.

*Attesting Officer*

*Commissioner of Patents and Trademarks*